US005081490A

United States Patent [19]

Wakao

[11] Patent Number: 5,081,490

[45] Date of Patent: Jan. 14, 1992

[54] METHOD OF CONTROLLING IMAGE FORMING APPARATUS WHEN A JAM OCCURS IN THE ORIGINAL FEEDER

[75] Inventor: Naho Wakao, Machida, Japan

[73] Assignee: Canon Kabushiki Kaisha, Tokyo, Japan

[21] Appl. No.: 618,457

[22] Filed: Nov. 27, 1990

[30] Foreign Application Priority Data

Dec. 8, 1989 [JP] Japan ..... 1-319933

[51] Int. Cl.[5] ..... G03G 21/00

[52] U.S. Cl. ..... 355/206; 271/3; 271/65; 271/258; 355/309; 355/321

[58] Field of Search ..... 271/3, 4, 65, 176, 258, 271/298; 355/308, 309, 321, 316, 319, 320, 317, 203, 205, 206, 207

[56] References Cited

U.S. PATENT DOCUMENTS 4,332,462 6/1982 Yagasaki et al. ..... 355/309
4,372,673 2/1983 Tomosada et al. ..... 355/206
4,655,582 4/1987 Okuda et al. ..... 355/206 X
4,730,204 3/1988 Satoh et al. ..... 355/208
4,750,020 6/1988 Ishizu et al. ..... 355/205

*Primary Examiner*—A. T. Grimley
*Assistant Examiner*—William J. Royer
*Attorney, Agent, or Firm*—Fitzpatrick, Cella, Harper & Scinto

[57] ABSTRACT

In a method of controlling copying-paper feed in an image forming apparatus having a recycling original feeder for feeding a sheet of an original mounted on a tray to an original reading portion, a paper supply unit for starting a paper supply operation of a sheet material, and a duplex unit with an intermediate tray, the steps of detecting a paper jam in the recycling original feeder, determining whether the paper supply unit has started its paper supply operation and then transmitting the sheet material to the sheet receiving member for temporarily storing the sheet material. After jam removal, the sheet material may then be routed to an image formation position.

6 Claims, 16 Drawing Sheets

METHOD OF CONTROLLING IMAGE FORMING APPARATUS WHEN A JAM OCCURS IN THE ORIGINAL FEEDER

BACKGROUND OF THE INVENTION

1. Field of the Invention

This invention relates to a method of controlling copying-paper feed in an image forming apparatus, and more particularly, to a method of controlling an image forming apparatus having, for example, an original feeder.

2. Description of the Related Art

A conventional image forming apparatus having an original feeder will now be explained by reference to FIGS. 1-13.

In FIGS. 1-13, there is shown a main body 1 of the copier, a recycling original feeder 2 (termed hereinafter an "ROF"), a sorter 3 (termed hereinafter a "stapler/-sorter") having a stapler 5, and a large-capacity accumulation tray 4 (termed hereinafter a "paper deck").

When the user intends to have m copies of an original composed of n pages followed by sorting and stapling using this apparatus, he places the original O on a tray 11 of the ROF 2, selects a staple/sort mode, sets the number m of copies, presses a copy button (not shown) on the main body 1 of the copier. As shown in FIG. 2, the ROF 2 rotates a paper supply roller 12, a feed roller 13 and a separation belt 14 in the directions of arrows "a", "b" and "c", respectively, and first feeds the bottom sheet of the original O as shown in FIG. 3. As shown in FIG. 4, after the front end of the sheet of the original O has been detected by a sensor 16, the sheet is fed while stopping registration rollers 15 for a predetermined time, to form a loop. Subsequently, by rotating the registration rollers 15 in the direction of arrows "e", as shown in FIG. 5, and rotating a feed belt 17 in the direction of arrow "f", as shown in FIG. 6, the sheet is fed to and stopped on a platen 18. Supply of the sheet is thus terminated.

The main body 1 of the copier has an upper cassette 6U, a lower cassette 6B and a deck 4, each for mounting copying paper P. An explanation will now be provided of a case in which the deck 4 is used. A paper-supply roller 31 and first feed rollers 32 in the deck 4 start to rotate immediately after the user has pressed the copy button, and rollers 31 and 32 feed the uppermost sheet of the copying paper P. As shown in FIG. 7, the paper supply roller 31 stops its rotation immediately before the rear end of the sheet passes through the paper supply roller 31. When the front end of the sheet has contacted second feed rollers 33 and a certain degree of loop has been formed in the sheet, the first feed rollers 32 stop rotation, and return to a wait stage.

When the sheet of the original O has stopped at a predetermined position on an original-mount glass 18 by the operation of the ROF 2, exposure is started. A photosensitive drum 34 starts to rotate. Mirrors 36-38 and a halogen lamp 35 project light onto the sheet while moving in the direction of arrow "g" at the same speed as the circumferential speed of the photosensitive drum 34. Toner is supplied from a developing unit 39, and the image on the sheet of the original O is formed on the drum 34. As shown in FIG. 8, the first and second feed rollers 32 and 33, which have been in a waiting state until the front end "h" of the image coincides with the front ends of the second feed rollers 33, start to rotate, and the toner on the drum 34 is transferred to the sheet of the copying paper P. The sheet of the copying paper P having the toner on its surface passes onto a feed belt 40 and through a pair of fixing rollers 41, and is discharged into the stapler/sorter 3 via conveying roller paper-discharge 42 and rollers 43. A bin unit 51 in the stapler/sorter 3, movable up and down in the directions of arrows "i", has a plurality of bins 52 for sorting, and is arranged so that, when m copies each composed of n sheets are to be prepared, the first copy, second copy and m-th copy are discharged into the first bin, second bin and m-th bin, respectively. Accordingly, m copies are prepared by operating only the main body 1 of the copier in the same manner as described above while the sheet of the original O which has previously been supplied to the original mounting glass 18 is not moved, and the m copies are received within the respective bins 52. After the m copies have been prepared, the sheet of the original O is returned to tray 11 in the direction of arrow "j" via a reversal roller 19 and paper-discharge rollers 20, as shown in FIG. 9. The next sheet of an original O is supplied during the discharge operation of the preceeding sheet, and is copied in the main body 1 of the copier. Sheets of the copying paper P having images copies from an original O are stored within the 1st m-th bins of the stapler/sorter 3. Thus, m copies of the mounted original O composed of n sheets are prepared. Subsequently, the sheets having copies images stored in the respective bins are successively stapled by the stapler 5 in sequence from the 1st or m-th bin while the bin unit 51 moves in the direction "i".

Next, an explanation will be provided of a case in which m double-sided copies each composed of n sheets are to be prepared from a single-sided original composed of n pages.

First, a sheet of the original is fed onto the original-mount glass 18 by the ROF 2 as in the case of preparing single-sided copies from a single-sided original. A sheet of the copying paper P is supplied to the drum 34 in the same manner as in the case of single-sided copies. A toner image is then transferred to the copying paper P, and the toner image on the sheet is fixed as the sheet passes through the fixing rollers 41. A movable guide 44 is positioned as shown in FIG. 10 by turning on a solenoid (not shown), and, as a result, the sheet of the copying paper P enters a duplex unit 7 where it is mounted onto an intermediate tray 61, as shown in FIG. 11. When m copies have been prepared, the ROF 2 discharges the original from which the copies have been prepared, as in the same manner as described above, the next original is supplied. The main body 1 of the copier releases a shutter 62 in the intermediate tray 61 by a solenoid (not shown). A paper supply roller 63 is placed on the sheets of the copying paper P in the intermediate tray 61 by a function of a solenoid or the like, starts to rotate, and supplies the uppermost sheet while separating the sheets one by one to a separation roller 64 and a feed roller 65. As shown in FIG. 12, the sheet is fed by rollers 69 and 68, and are pinched by feed rollers 32. Subsequently, a copying operation is performed in the same manner as in the case of supplying a sheet from the deck 4, and the sheet having a copied image is discharged into the stapler/sorter 3.

In the above-described conventional case, if a paper jam occurs while the ROF 2 feeds a sheet of the original O, an already-supplied sheet of the copying paper P, which has not yet had an image transferred to it, is situated before the second feed rollers 33. If the sheet of the copying paper P is stopped at that position and the apparatus tries to use the sheet after a jam recovery, the sheet may itself jam since once the sheet is bent by a guide or the like it has a habit of maintaining the bent state. Hence, it is necessary to discharge the blank sheet of copying paper P immediately after the occurrence of jam.

Accordingly, the prior art has the disadvantage that blank sheets are mixed and stored in a stapler/sorter (or a paper discharge tray), and are stapled in that stage.

When a sorter having fixed bins as shown in FIG. 13 is used, there have been cases wherein blank sheets are discharged onto bins 204, 205, 206 and the like which do not contain sheets having copies images. In the case of a sorter having moving bins, however, the prior art has the disadvantage that one must wait for discharge of blank papers until bins not containing sheets having copied images move up to a discharge port.

SUMMARY OF THE INVENTION

The present invention has been made in consideration of the above-described disadvantages in the prior art.

It is an object of the present invention to provide a method of controlling copying-paper feed in an image forming apparatus so that a previously-fed sheet of copying paper is not discharged as a blank sheet.

According to the present invention, an original feed unit is characterized in that, when paper-feed jam occurs, a sheet of copying paper fed into a main body of a copier is discharged onto an intermediate tray for temporarily storing a sheet when a double-sided (multiple) copy is prepared in the state of a blank sheet.

As explained above, when a sheet of an original is jammed in the ROF, a previously fed sheet of copying paper on which an image has not yet been printed is not routed to a sorter or the like as a blank sheet. Hence, this eliminates the problem of removing staples in order to extract mixed blank sheets after sheets having copied images have been stapled.

Furthermore, when the copying operation is resumed after jam recovery of the original feeder, if the copying operation is performed on a sheet of a copying paper (a blank sheet) discharged onto the intermediate tray by passing the sheet through the same path as in the case of a double-sided copy, the waste of sheets can be prevented, and it becomes unnecessary to remove the sheet on the intermediate tray by hand.

DESCRIPTION OF THE PREFERRED EMBODIMENTS

Embodiments of the present invention differ from the conventional method in the operation during paper jam. Hence, an explanation will be provided by reference to FIG. 1 which has been used as the cross-sectional view of the apparatus in the conventional method.

Figure 1:
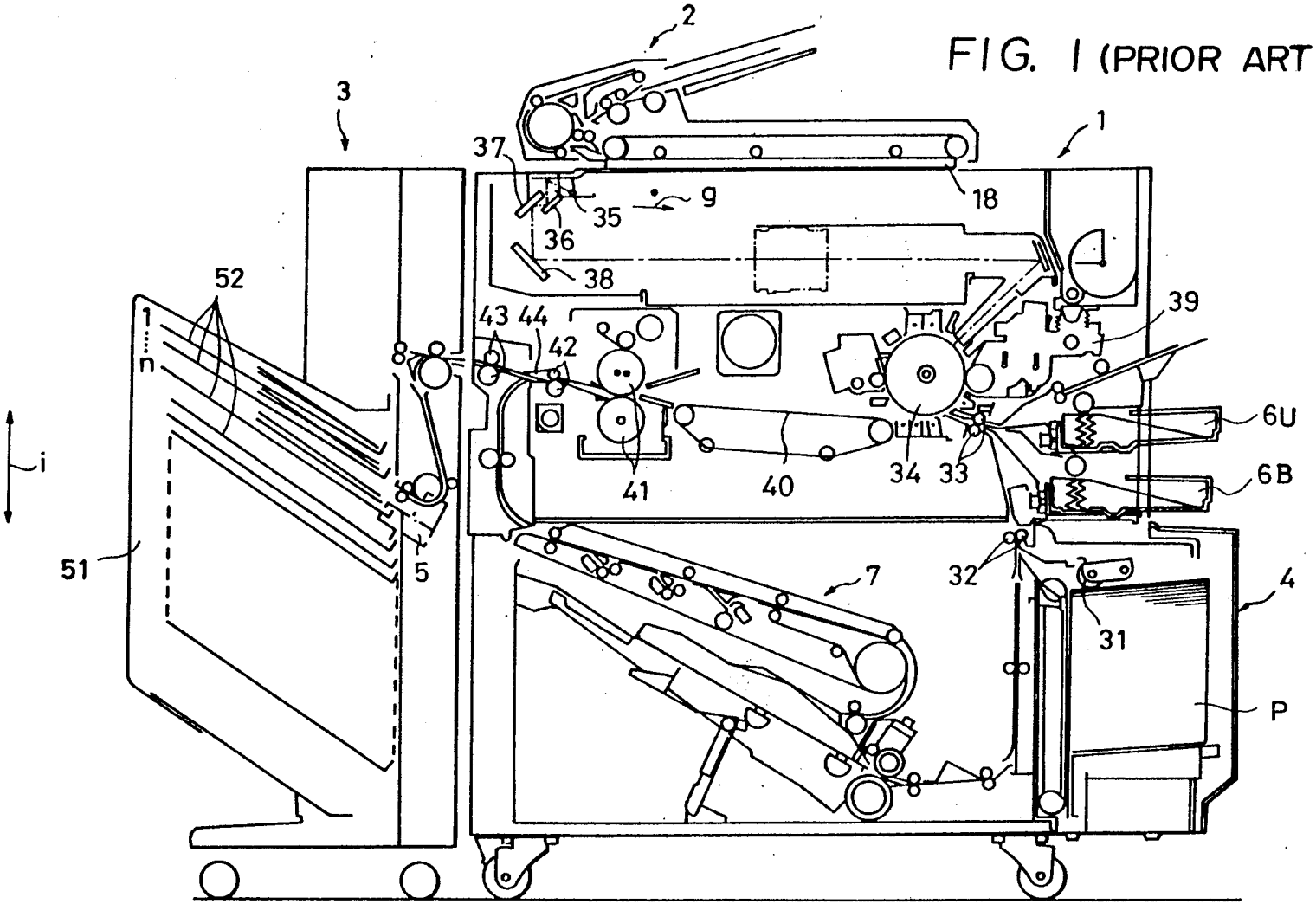
FIG. 1 (PRIOR ART)
FIG. 1 is a cross-sectional view of a conventional image forming apparatus.
Figure 2:
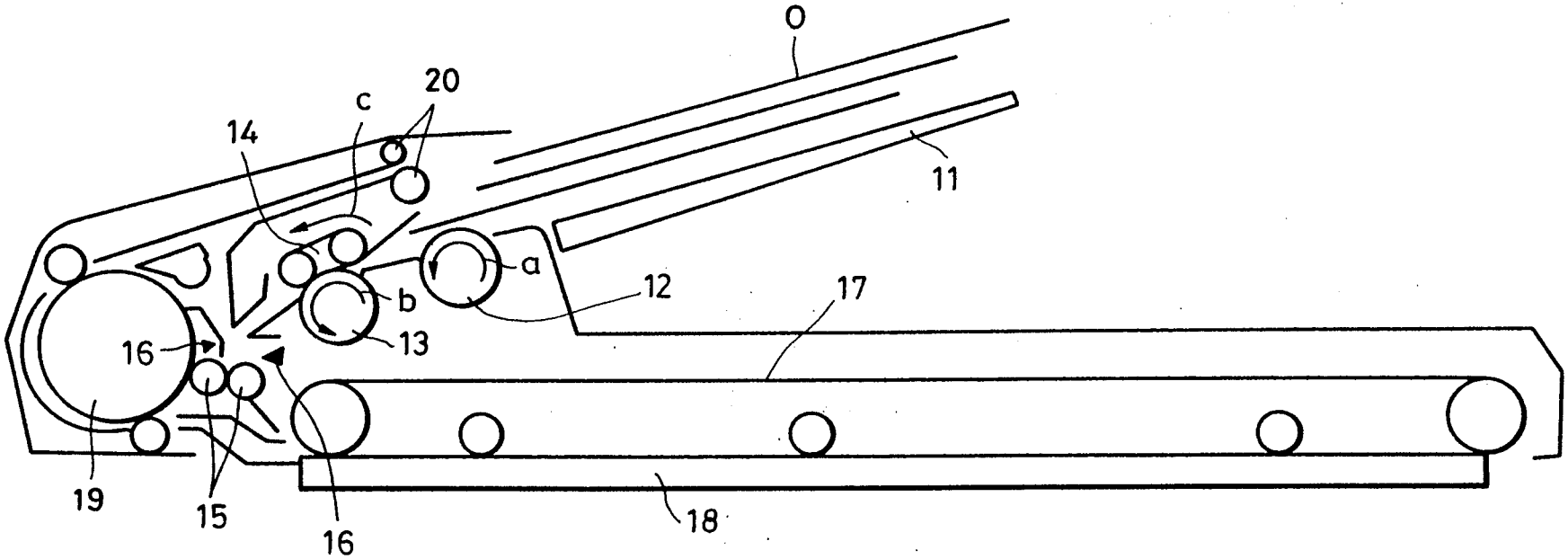
FIG. 2 (PRIOR ART)
FIG. 2 is an enlarged cross-sectional view of a conventional recycling original feeder.
Figure 3:
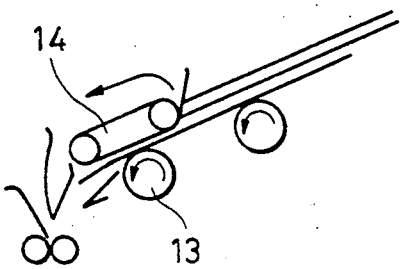
FIG. 3 (PRIOR ART)
FIGS. 3–6, and 9 are diagrams for explaining the operation of the original feeder of FIG. 2.
Figure 5:
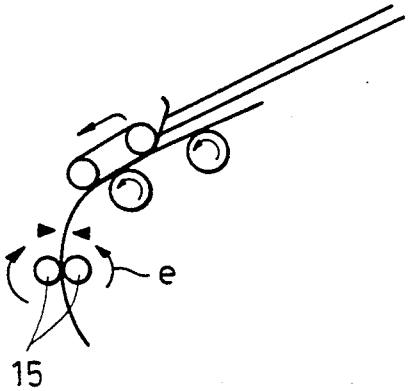
FIG. 5 (PRIOR ART)
Figure 4:
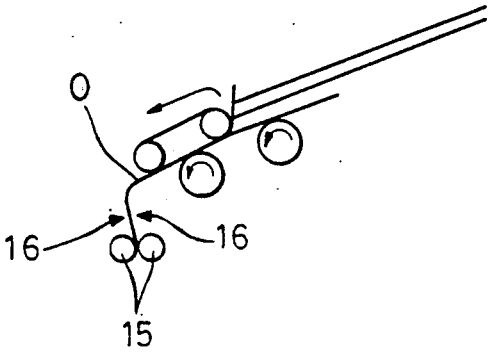
FIG. 4 (PRIOR ART)
Figure 6:
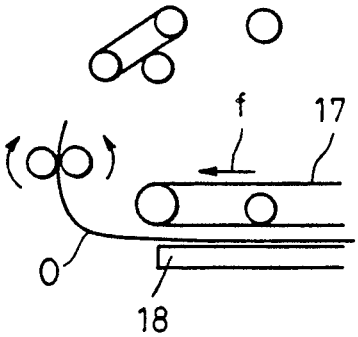
FIG. 6 (PRIOR ART)
Figure 7:
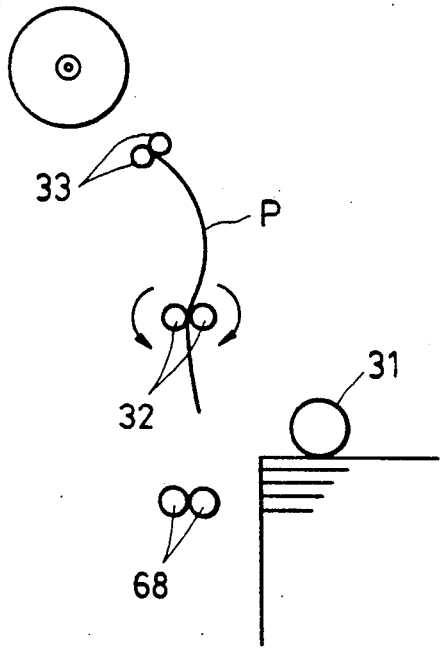
FIG. 7 (PRIOR ART)
FIGS. 7 and 8 are diagrams for explaining the operation of a conventional paper supply unit of the image forming apparatus.
Figure 8:
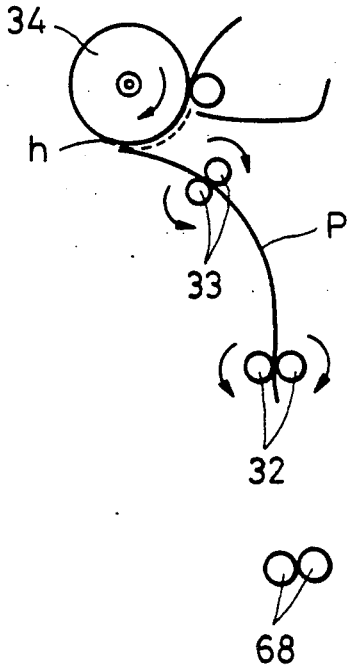
FIG. 8 (PRIOR ART)
Figure 9:
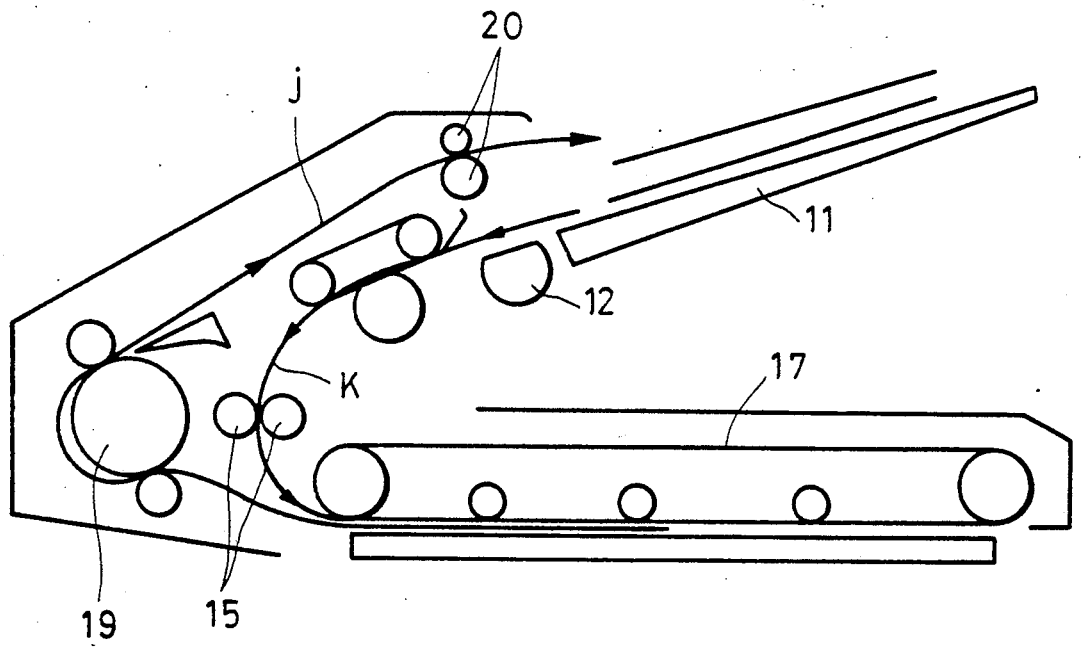
FIG. 9 (PRIOR ART)
Figure 10:
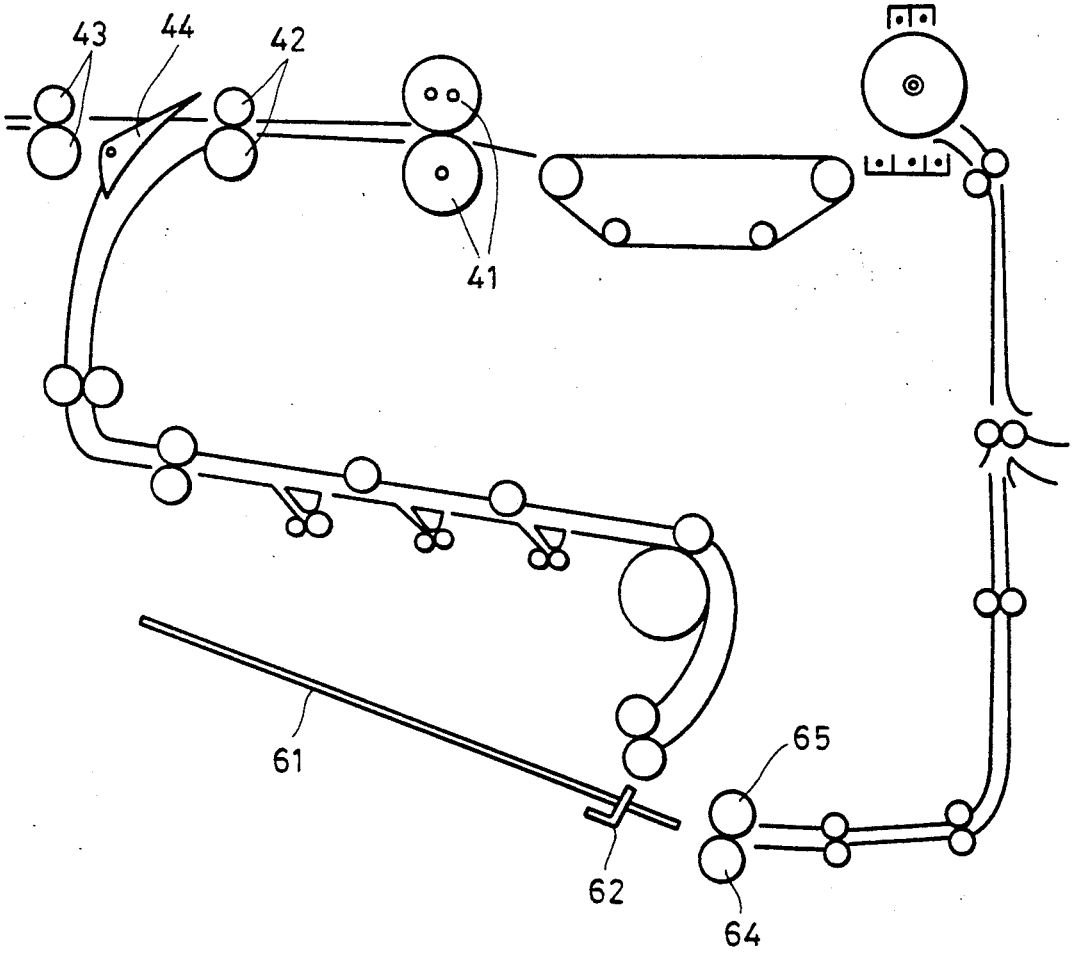
FIG. 10 (PRIOR ART)
FIGS. 10–12 are diagrams for explaining the operation of a conventional paper feed unit of the image forming apparatus.
Figure 11:
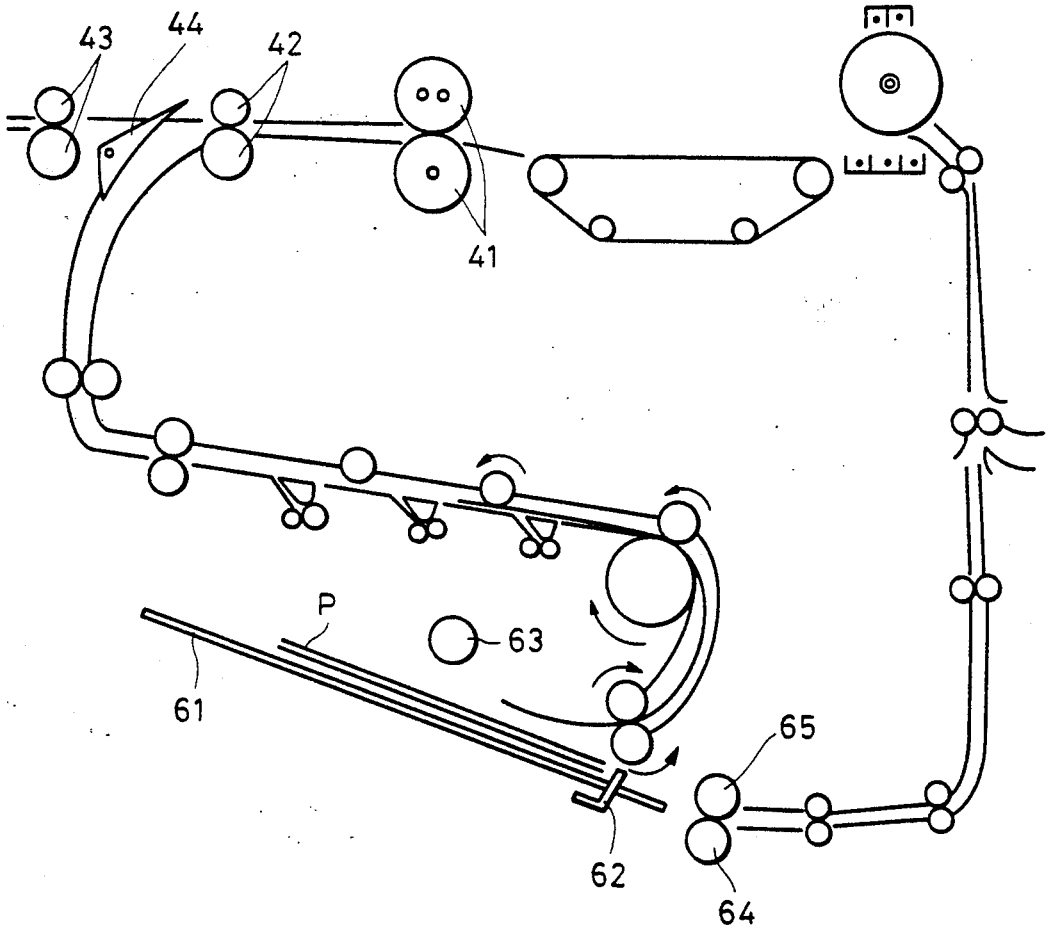
FIG. 11 (PRIOR ART)
Figure 12:
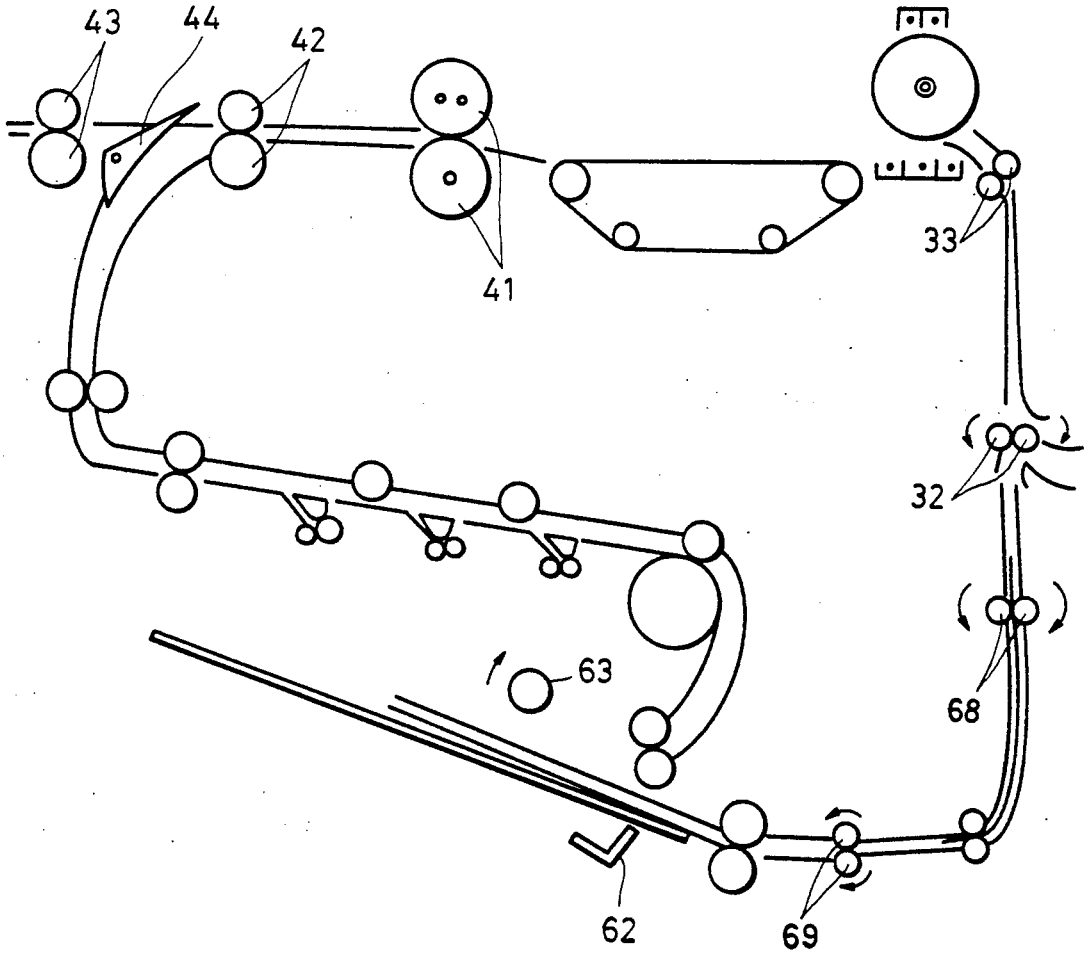
FIG. 12 (PRIOR ART)
Figure 13:
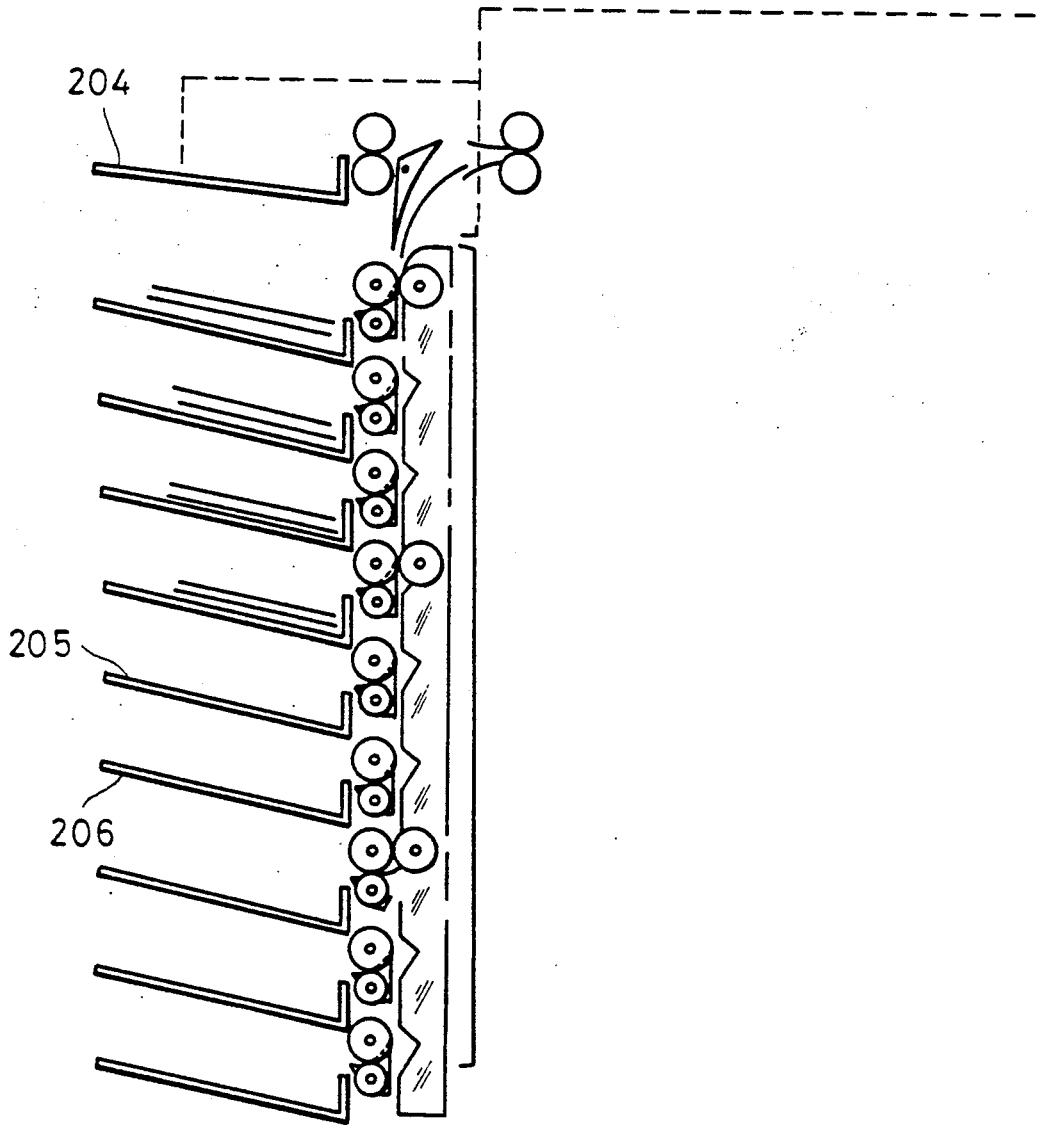
FIG. 13 (PRIOR ART)
FIG. 13 is a cross-sectional view of a conventional sorter.

In FIG. 1, there is shown a main body 1 of a copier, an ROF 2, a stapler/sorter 3, a deck 4 and a duplex unit 7.

A normal copying operation is the same as in the conventional method.

Figure 14:
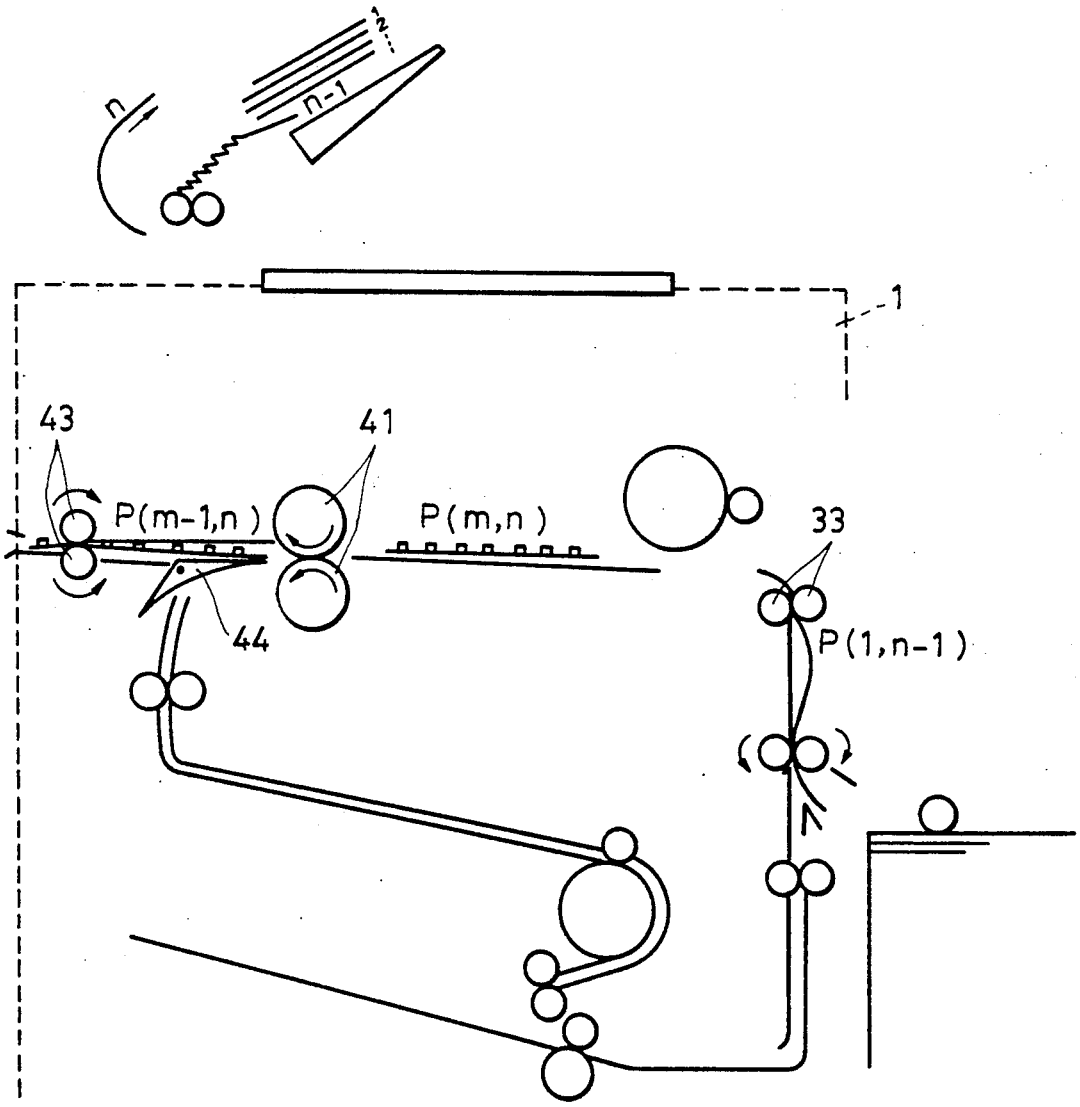
FIGS. 14–19 are cross-sectional views for explaining the movement of a sheet material by a control method according to the present invention.
Figure 15:
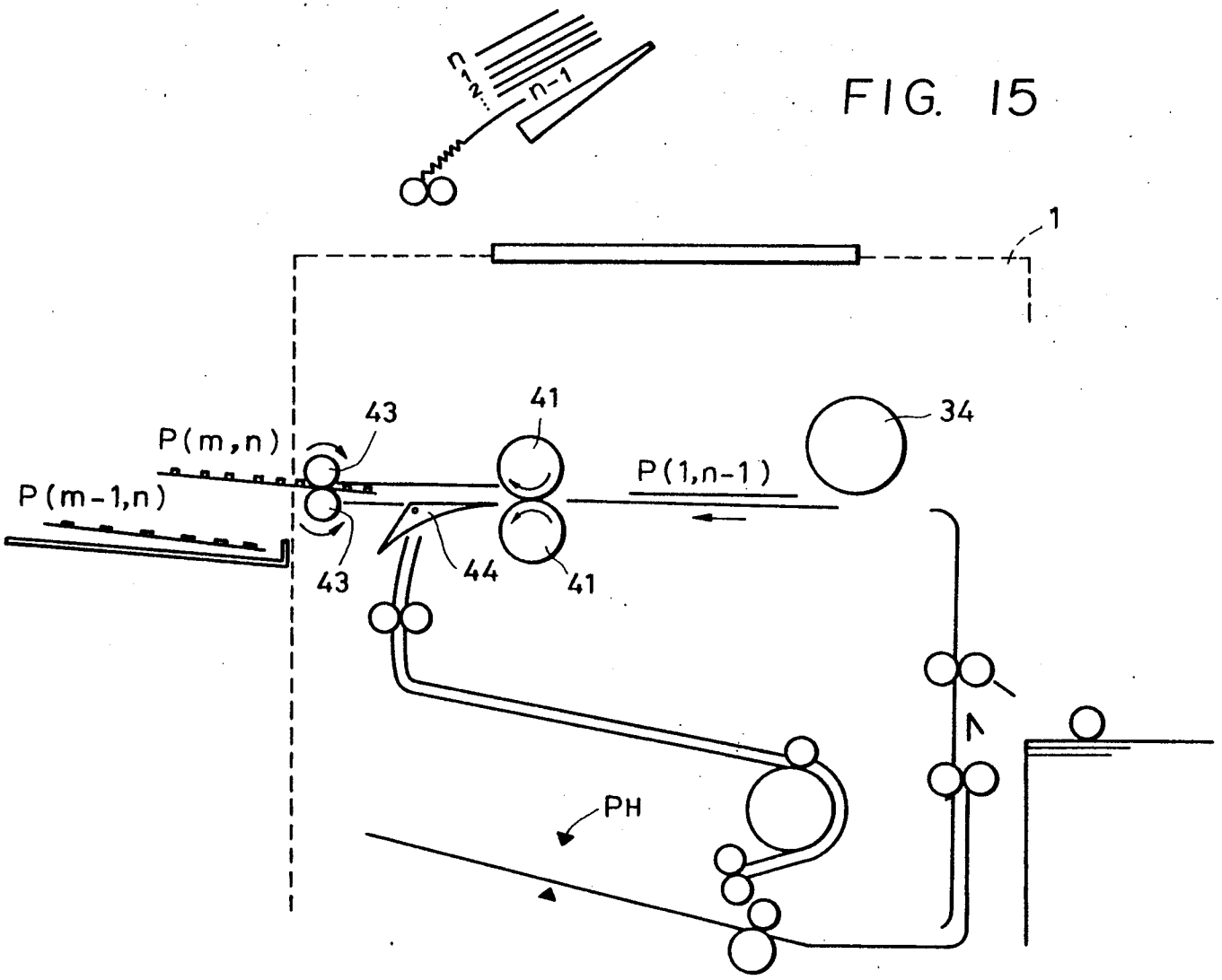
Figure 16:
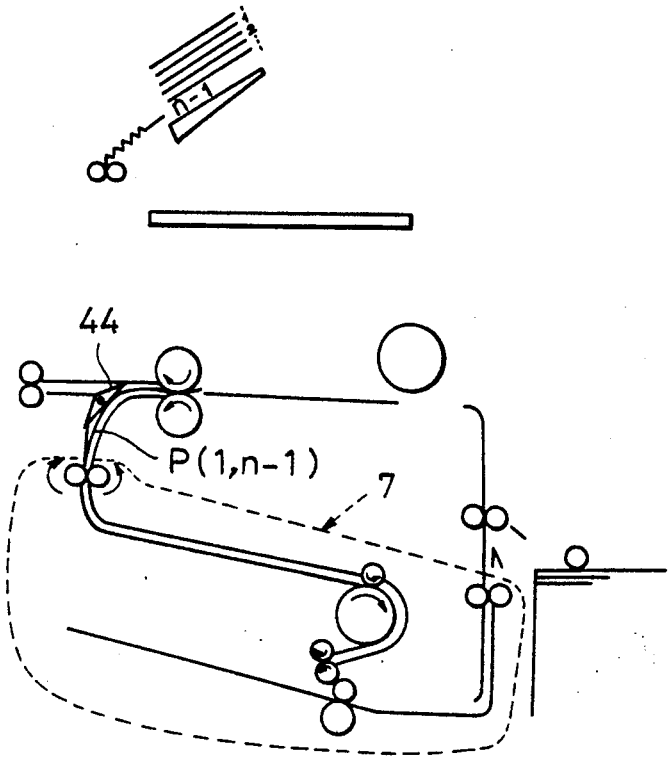
Figure 17:
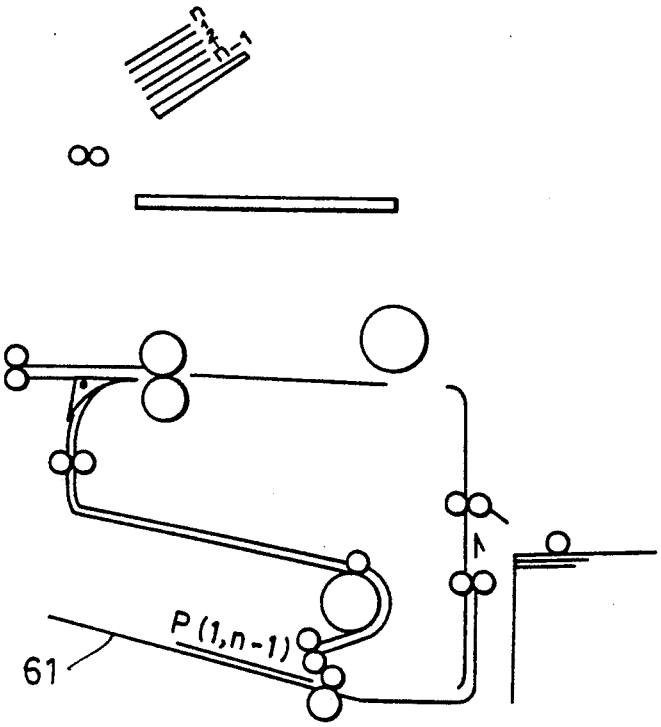
Figure 18:
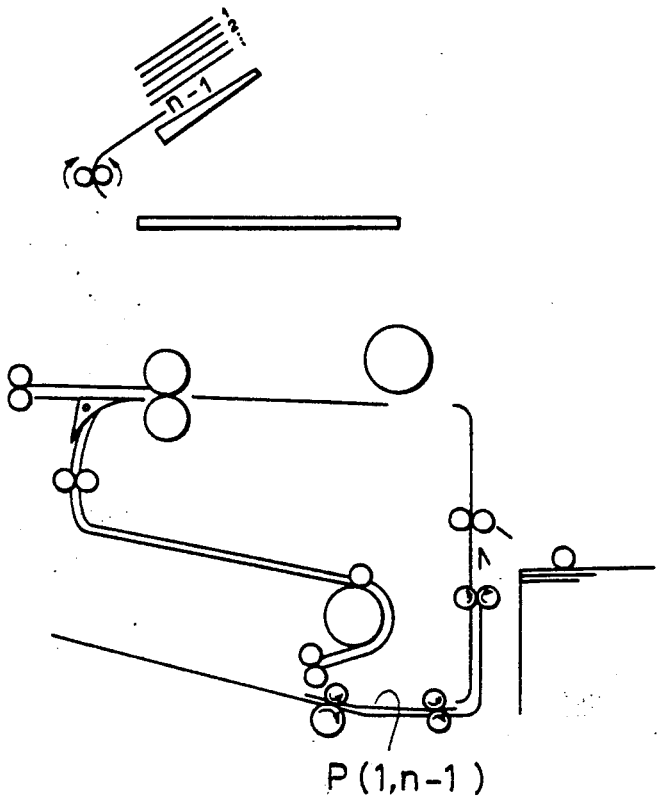
Figure 19:
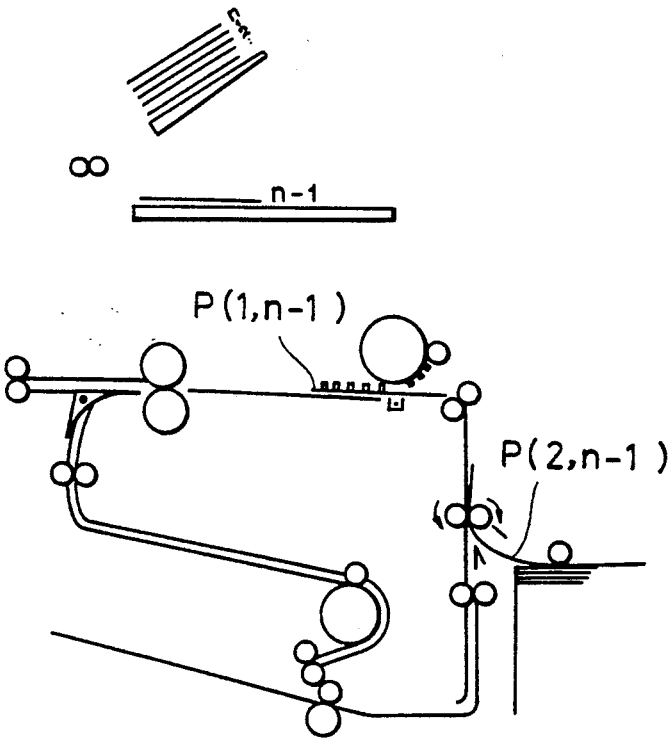
Figure 21:
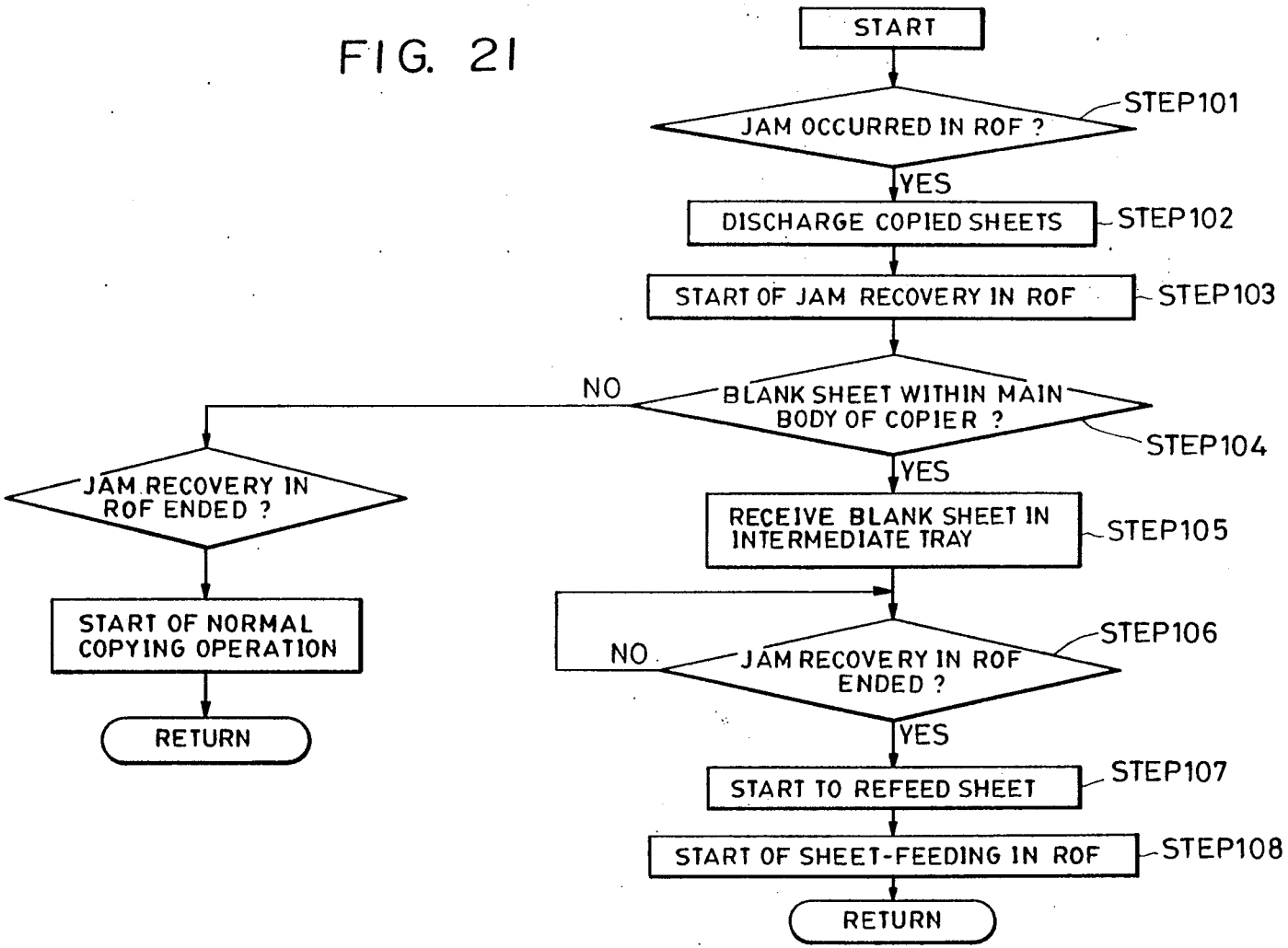
FIG. 21 is a flowchart of the present invention.

Next, an explanation will be provided of a case in which a paper jam occurs in the ROF 2 by reference to FIGS. 14–19 and the flowchart shown in FIG. 21. A particular case in which paper jam occurs at the (n−1)-th sheet while making m copies of an original composed of n sheets will be explained. The ROF 2 first supplies the lowermost n-th sheet of the original, and the main body 1 of the copier sequentially transfers images onto sheets P(1, n), P(2, n), . . . P(m−2, n), P(m−1, n) and P(m, n). When transfer onto the sheet P(m, n) has ended, the ROF 2 feeds the (n−1)-th sheet of the original while discharging the n-th sheet of the original. The main body 1 of the copier feeds sheet P(1, n−1) for transferring the image on the (n−1)-th sheet of the original, and stops the front end of the copier feed sheet at the position of second feed rollers 33 to thereby provide a waiting state. Suppose at this time that paper jam occurs (a jam occurrence signal is generated) during the paper feed operation by the ROF 2, as shown in FIG. 14 (step 101). At this time, in step 102, the sheets P(m−1, m) and P(m, n) to which the images have been transferred are discharged from the main body 1 of the copier via fixing rollers 41 and paper discharge rollers 43, as shown in FIG. 15. The sheet P(1, n−1) fed in order to transfer the image on the (n−1)-th sheet of the original thereto passes through drum 34 but remains blank because the image forming means does to operate. After the time needed for the sheet P(m, n) to pass, movable guide 44 moves to an up position as shown in FIG. 16. The sheet P(1, n−1), which remains blank, enters the duplex unit 7, and is mounted onto an intermediate tray 61, as shown in FIG. 17 (step 105). The movable guide 44 is then restored to its down position as shown in FIG. 14. On the other hand, the user who has noticed the paper jam in the ROF 2 removes the paper jam, restores the page order to the initial order (1, 2, . . . , n−1, n), and returns the removed sheet of the original onto tray 11. After a copy button has been turned on, the ROF 2 starts jam recovery (step 106), and returns the n-th sheet of the original for which exposure has ended to the uppermost position on the bundle of the originals. Subsequently, the ROF 2 starts to feed the (n−1)-th sheet of the original (step 108). Nearly at the same time or somewhat earlier, refeed of the sheet P(1, n−1) mounted on the intermediate tray 61 starts, as shown in FIG. 18 (step 107). The sheet P(1, n−1) passes along the same path as that in a normal refeed operation, and the image is transferred to the sheet P(1, n−1) by a transfer unit, as shown in FIG. 19.

The next sheet P(2, n−1) is supplied from sheets mounted on the deck 4.

Figure 22:
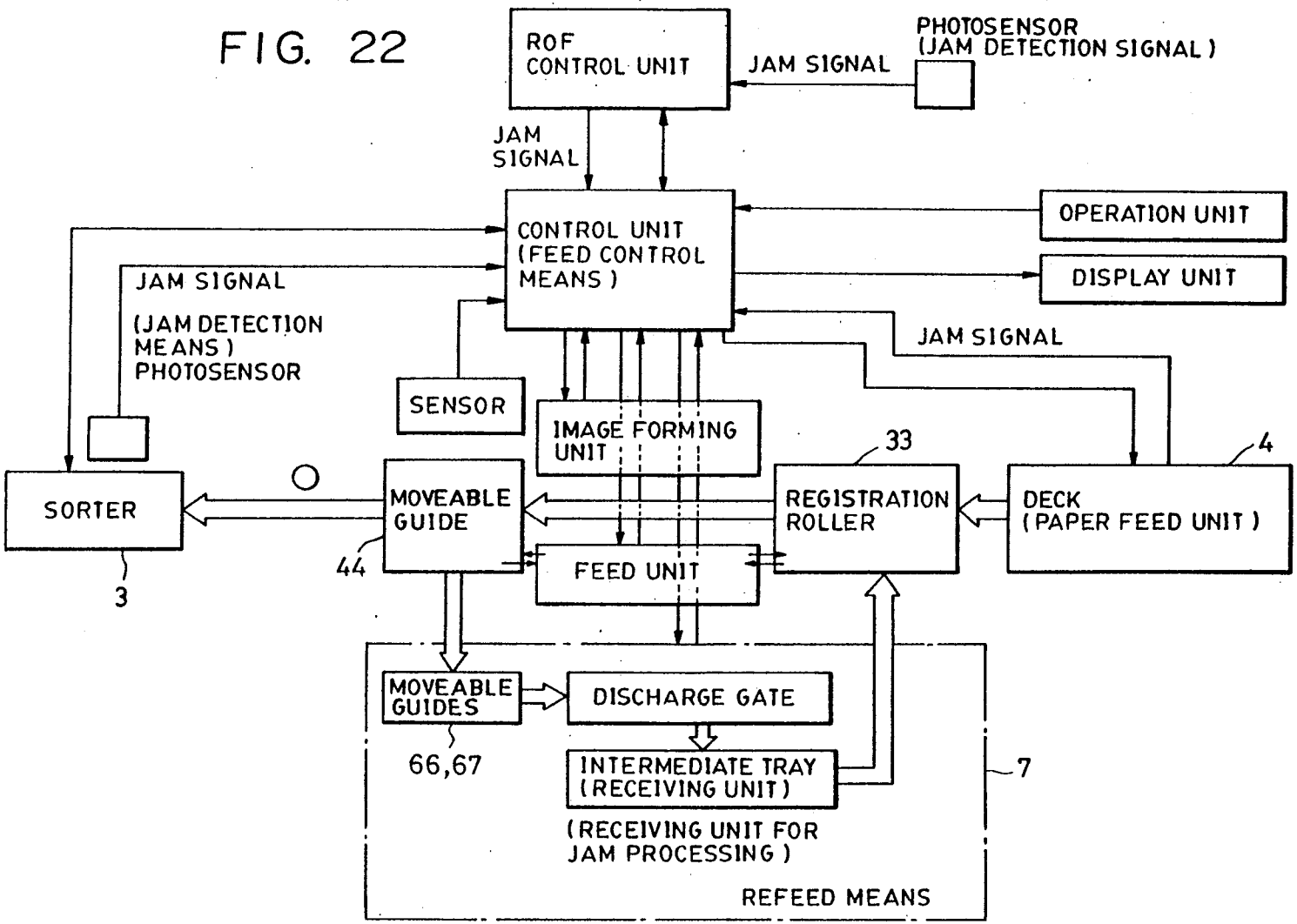
FIG. 22 is a control block diagram of the present invention.

A block diagram of the configuration for the above-described operation is shown in FIG. 22.

If an unaccustomed user, not noticing paper feed merely in the ROF 2, opens the main body 1 of the copier and removes the sheet P(1, n−1) on the duplex unit 7, the fact that the sheet has been removed is detected by a photosensor PH (FIG. 15) on the intermediate tray 61 or the like. The main body 1 of the copier then supplies a sheet of the copying paper from the deck 4 after the copy button has been turned on.

Although, in the foregoing embodiment, an explanation has been provided of a case in which single-sided copies are prepared from a single-sided draft, the above-described approach may also be applied when double-sided copies are prepared from a single-sided or double-sided draft.

Figure 20:
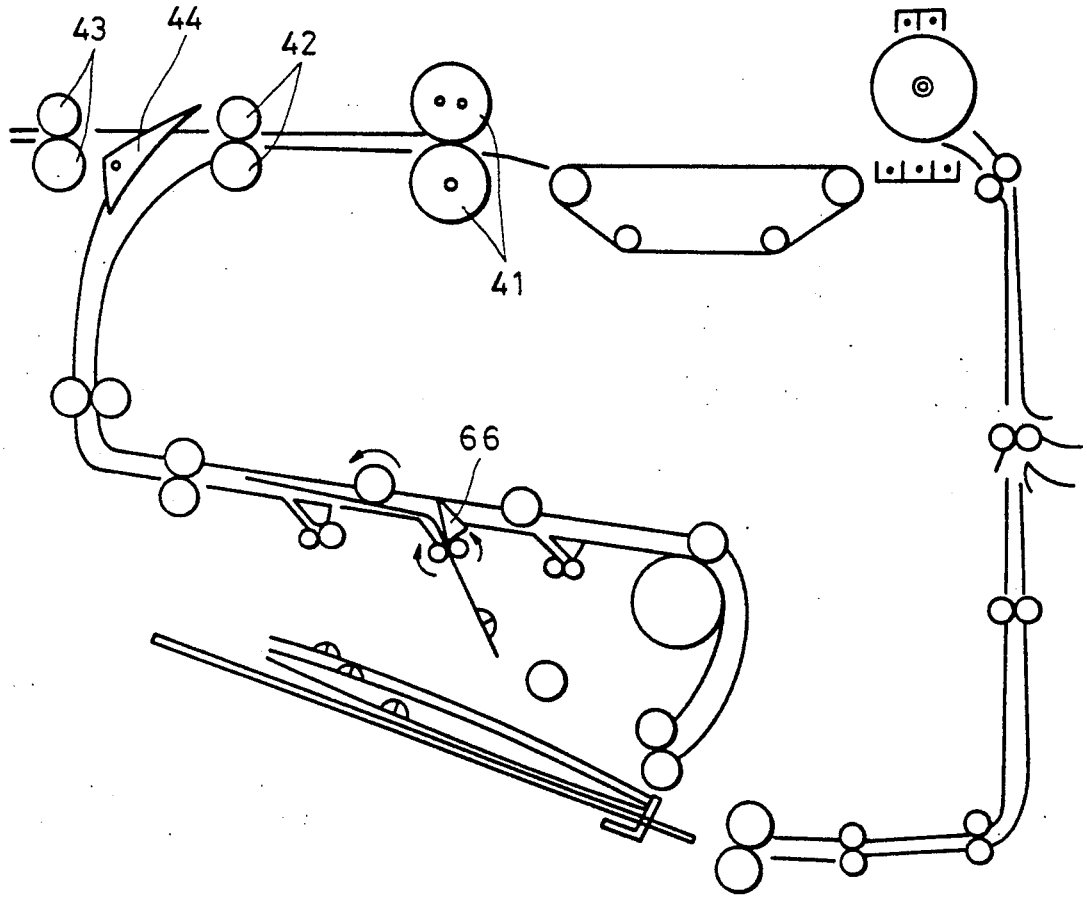
FIG. 20 is a cross-sectional view for explaining the movement of a sheet material in the case of a double-sided copy by the control method of the invention.

If paper jam occurs in the ROF 2 while the next sheet of the draft is supplied (or while the sheet of the draft is reversed in the case of a double-sided draft) after single-sided copies have been prepared and mounted on the intermediate tray 61, the sheet supplied from the intermediate tray 61 must be directly discharged onto the intermediate tray 61. In this case, however, since the face of the sheet is reversed if the sheet is received in the intermediate tray 61 in a normal way, the sheet may be received in the intermediate tray 61 in a multiple mode (wherein the face of the sheet is not reversed), as shown in FIG. 20. A movable guide 66 situated at a position determined in accordance with the size of the sheet changes its direction by a solenoid (not shown), as shown in FIG. 20. The sheet passes along a path thereby formed, and is returned again onto the tray 61. Thus, the face of the sheet is not reversed. Hence, the entirely same operation as a normal paper refeed operation may be performed after jam recovery in the RDF 2.

To the contrary, if jam of a sheet of the original occurs in the multiple mode, the preceding blank sheet of the copying paper is received within the intermediate tray 61 while the multiple mode is maintained.

What is claimed is:

1. A method of controlling copying-paper feed in an image forming apparatus comprising an original feeder for feeding a sheet of an original mounted on an original mount to an original reading portion, a paper supply unit for starting a paper supply operation of a copy paper during or before starting a paper feed operation by said original feeder, and means for reading an image on the fed sheet of the original and forming the image on the supplied copy paper, wherein said copy paper is received in a sheet receiving member communicating with a feed path and used for temporarily storing the copy paper, if said paper supply unit had already entered the paper supply operation of the copy paper when paper jam occurred during the paper feed operation by said original feeder.

2. A method of controlling copying-paper feed in an image forming apparatus according to claim 1, wherein said sheet receiving member is an intermediate tray in a duplex unit for temporarily storing the copy paper during a double-sided or multiple copying operation.

3. A method of controlling copying-paper feed in an image forming apparatus according to claim 1, further comprising the step of routing said copy paper from said sheet receiving member to a position within said image forming apparatus for forming an image thereon, said routing taking place after jam recovery in said original feeder has ended.

4. A method of controlling copying-paper feed in an image forming apparatus according to claim 2, wherein the copy paper is temporarily stored in the intermediate tray in a multiple mode when jam of the original has occurred in a double-side mode.

5. A method of controlling copying-paper feed in an image forming apparatus according to claim 2, wherein the copy paper is temporarily stored in the intermediate tray while staying in a multiple mode when jam of the original has occurred in the multiple mode.

6. A method of controlling copying-paper feed in an image forming apparatus, said apparatus having a recycling original feeder for feeding originals mounted on a tray to an original reading platen, a paper supply unit for starting a copy paper supply operation, image forming means for reading an image from the original while on the platen and forming the image on the supplied copy paper and a duplex unit that contains a sheet receiving member, the method comprising the steps of:

detecting a paper jam in the recycling original feeder;

determining whether the paper supply unit has started its paper supply operation at the time of said paper jam; and upon determination that said paper supply unit has started its paper supply operation, transmitting said copy paper via a feed path to said sheet receiving member for temporarily storing said copy paper.

* * * * *

UNITED STATES PATENT AND TRADEMARK OFFICE

CERTIFICATE OF CORRECTION

PATENT NO. : 5,081,490

DATED : January 14, 1992

INVENTOR(S) : Naho WAKAO

It is certified that error appears in the above-identified patent and that said Letters Patent is hereby corrected as shown below:

COLUMN 2

Line 4, "roller" should --rollers 42 and--.
Line 5, "42 and" should be deleted.
Line 24, "copies" should --copied--.
Line 27 "copies" should --copied--.
Line 50, "above," should read --above, and--.

COLUMN 3

Line 10, "stage." should read --state.--.
Line 14, "copies" should --copied--.

Signed and Sealed this

Eighth Day of June, 1993

*Attest:*

Michael K. Kirk

MICHAEL K. KIRK

*Attesting Officer*

*Acting Commissioner of Patents and Trademarks*